US008535867B2

(12) United States Patent
Suwa et al.

(10) Patent No.: US 8,535,867 B2
(45) Date of Patent: Sep. 17, 2013

(54) FERRITE CORE MATERIAL AND FERRITE CARRIER FOR ELECTROPHOTOGRAPHIC DEVELOPER, AND ELECTROPHOTOGRAPHIC DEVELOPER USING THE FERRITE CARRIER

(75) Inventors: Tomoyuki Suwa, Chiba (JP); Toru Iwata, Chiba (JP); Koji Aga, Chiba (JP)

(73) Assignee: Powdertech Co., Ltd., Chiba (JP)

( * ) Notice: Subject to any disclaimer, the term of this patent is extended or adjusted under 35 U.S.C. 154(b) by 203 days.

(21) Appl. No.: 13/020,455

(22) Filed: Feb. 3, 2011

(65) Prior Publication Data

US 2011/0212399 A1 Sep. 1, 2011

(30) Foreign Application Priority Data

Feb. 26, 2010 (JP) ..... 2010-043286

(51) Int. Cl.
*G03G 9/08* (2006.01)

(52) U.S. Cl.
USPC ..... 430/111.31; 430/111.32; 430/111.33

(58) Field of Classification Search
USPC ..... 430/111.31, 111.32, 111.33
See application file for complete search history.

(56) References Cited

U.S. PATENT DOCUMENTS

2007/0231731 A1* 10/2007 Suwa et al. ..... 430/111.33
2009/0246670 A1* 10/2009 Aga et al. ..... 430/108.6

FOREIGN PATENT DOCUMENTS

| | | |
|---|---|---|
| JP | 52056536 | 5/1977 |
| JP | 8-22150 | 1/1996 |
| JP | 2006-17828 | 1/2006 |
| JP | 2006-267345 | 10/2006 |
| JP | 2007-271663 | 10/2007 |

* cited by examiner

*Primary Examiner* — Mark A Chapman
(74) *Attorney, Agent, or Firm* — Greenblum & Bernstein, P.L.C.

(57) ABSTRACT

There is provided a ferrite core material for an electrophotographic developer, the ferrite core material having a ferrite particle composition represented by the formula (1) shown below, containing SrO replacing a part of (MnO) and/or (MgO) in the formula (1) shown below, and having a Cl concentration of 0.1 to 100 ppm, as measured by an elution method of the ferrite core material:

$$(MnO)x(MgO)y(Fe_2O_3)z \quad (1)$$

wherein x=35 to 45 mol %, y=5 to 15 mol %, z=40 to 60 mol %, and x+y+z=100 mol %.

10 Claims, No Drawings

FERRITE CORE MATERIAL AND FERRITE CARRIER FOR ELECTROPHOTOGRAPHIC DEVELOPER, AND ELECTROPHOTOGRAPHIC DEVELOPER USING THE FERRITE CARRIER

BACKGROUND OF THE INVENTION

1. Field of the Invention

The present invention relates to a ferrite core material and a resin-coated carrier using the ferrite core material, used for a two-component electrophotographic developer used in copying machines, printers and the like, and particularly to a ferrite core material and the ferrite carrier for an electrophotographic developer, which provide a desired charge amount and exhibit a small environmental variation in the charge amount and an electrophotographic developer using the ferrite carrier.

2. Description of the Related Art

The method of electrophotographic development is a method in which toner particles in a developer are made to carry over on an electrostatic latent image formed on a photoreceptor to develop the image. The developer used in this method is classified into a two-component developer composed of a toner particle and a carrier particle, and a one-component developer using a toner particle alone.

As a development method using a two-component developer composed of a toner particle and a carrier particle among those developers, a cascade method and the like were formerly employed, but a magnetic brush method using a magnet roll is now in the mainstream.

In a two-component developer, a carrier particle is a carrier substance which is stirred with a toner particle in a development box filled with the developer to thereby impart a desired charge to the toner particle, and further transports the charged toner particle onto a surface of a photoreceptor to thereby form a toner image on the photoreceptor. The carrier particle remaining on a development roll holding a magnet is again returned from the development roll to the development box, mixed and stirred with a fresh toner particle, and used repeatedly in a certain period.

In a two-component developer, unlike a one-component developer, a carrier particle has functions of being mixed and stirred with a toner particle to charge the toner particle and transporting the charged toner particle, and thus has good controllability on designing a developer. Therefore, the two-component developer is suitable for full-color development apparatuses requiring a high image quality, high-speed printing apparatuses requiring reliability and durability in image maintenance, and other apparatuses.

In a two-component developer thus used, it is needed that image characteristics, such as image density, fogging, white spots, gradation and resolving power, exhibit predetermined values from the initial stage, and additionally these characteristics do not vary and are stably maintained during the endurance printing period. In order to stably maintain these characteristics, properties of a carrier particle contained in a two-component developer need to be stable.

As a carrier particle forming a two-component developer, various types of iron powder carriers, ferrite carriers, resin-coated ferrite carriers and the like have conventionally been used.

Office networking has recently advanced where the times are evolving from monofunction copying machines to multifunction ones, and with respect to service systems, the times are shifting from a system in which a contract serviceman periodically performs maintenance including exchange of developers and the like to a maintenance-free system, so needs for the longer life of developers have been more and more raised from the market.

Japanese Patent Laid-Open No. 08-22150 describes a ferrite carrier for an electrophotographic developer, in which carrier a part of a ferrite composed of MnO, MgO and $Fe_2O_3$ is replaced by SrO. It is contended that the ferrite described in Japanese Patent Laid-Open No. 08-22150 can provide a carrier for an electrophotographic developer excellent in image quality and endurance, friendly to the environment, having a long life, and excellent in environmental stability, by reducing a variation in magnetization among ferrite carrier particles.

Japanese Patent Laid-Open No. 2007-271663 describes a ferrite carrier for an electrophotographic developer, which carrier has a compressive breaking strength of 150 MPa or higher, a compressive deformation ratio of 15.0% or more, and a shape factor SF-1 of 100 to 125, and in which carrier a part of a ferrite composed of MnO, MgO and $Fe_2O_3$ is replaced by SrO.

Japanese Patent Laid-Open No. 2007-271663 discloses a ferrite carrier for an electrophotographic developer, in which carrier the ferrite has a spherical shape, a high compressive breaking strength and compressive deformation ratio, an excellent strength against breaking by a stress imparted in a developing apparatus when used as a developer, and a suitable brittleness, thereby preventing carrier scattering and achieving an elongated life.

Japanese Patent Laid-Open No. 2006-17828 describes a ferrite for an electrophotographic developer, in which ferrite the composition of the ferrite particle is composed of MnO, MgO and $Fe_2O_3$, and the ferrite particle a part of which is replaced by SrO and the like contains 40 to 500 ppm of zirconium. The ferrite carrier described in Japanese Patent Laid-Open No. 2006-17828 can suppress generation of charge leakage because the carrier has a high dielectric breakdown voltage, and consequently has a purpose of providing a high image quality.

However, the inventions described in these Japanese Patent Laid-Open Nos. 08-22150, 2007-271663 and 2006-17828 cannot meet recent high requirements for charge performances toward higher chargeability and simultaneous minimization of the environmental variation in the charge amount. Particularly, polymerized toners and low temperature-fixing toners recently often used often raises problems of exhibiting a relatively lower charge amount and a larger environmental variation in the charge amount than conventional toners, and in order to provide a desired high charge amount and suppress the environmental variation by combination with these recent toners, ferrites described in these documents are not sufficient.

The recent tendency of colorization and speeding-up further demands a higher toner density and a higher speed development, and under such conditions, although it is needed that ferrites have a markedly higher chargeability and are more stable than conventional ones, the ferrites described in the documents above cannot satisfy these requirements.

Japanese Patent Laid-Open No. 52-56536 describes a moisture-nonsensitive ferrite electron carrier substance the amounts of surface sodium and surface zinc of which are prescribed, and a method of producing the carrier substance. In Japanese Patent Laid-Open No. 52-56536, it is found that a major reason of a poor performance in a high humidity of conventional ferrite substances in electrophotographic apparatuses is that some substances, changing the surface conductivity and dielectric loss and changing the charge decay of a developer mixture, are present on the surface of ferrite particles, and it is contended that the substances are surface sodium, zinc oxide, calcium, potassium and the like bonded with a sulfate salt, and on that assumption, the amounts of surface sodium and surface zinc are prescribed as described above.

However, the invention described in this Japanese Patent Laid-Open No. 52-56536 is to prescribe the amounts of surface sodium and surface zinc, and is not to prescribe the amount of chlorine as the invention described later is.

Japanese Patent Laid-Open No. 2006-267345 describes a two-component developer using a carrier having a coated layer on a ferrite particle and containing a certain amount of chlorine element with respect to iron element. This Japanese Patent Laid-Open No. 2006-267345 pays its attention to the presence of trace elements contained in a carrier and influences thereby, and pays its attention particularly to that the chlorine element in the ferrite particle has an influence on the durability of the carrier, and indicates that the control of the amount of the chlorine element improves the hardness of the ferrite, develops a firm durability without chipping even under a load, and improves the adhesivity between the ferrite surface and a resin-coated layer due to the polar action of the chlorine element, consequently hardly allowing the resin-coated layer to be easily peeled.

This Japanese Patent Laid-Open No. 2006-267345 describes nothing with respect to an influence of the presence of the chlorine element on the ferrite core material surface on the charge amount. The Examples therein relate to a magnesium ferrite containing 40 mol % of MgO, and there is also no suggestion as to the composition and the replacement by SrO as described later.

A carrier for an electrophotographic developer is thus demanded which can provide a high charge amount and exhibits little variation in the charge amount against the environmental variation while holding an above-mentioned advantage of the ferrite carrier.

SUMMARY OF THE INVENTION

Therefore, it is an object of the present invention to provide a ferrite core material for an electrophotographic developer and a ferrite carrier which can provide a desired high charge amount and exhibit little environmental variation in the charge amount while holding an advantage of a ferrite carrier, and to provide an electrophotographic developer using the ferrite carrier.

As a result of exhaustive studies to solve the above-mentioned problems, the present inventors have found that the above-mentioned object can be achieved by making a ferrite core material having a specific composition, and suppressing the Cl concentration of the ferrite core material within a certain range. These findings have led to the present invention.

That is, the present invention provides a ferrite core material for an electrophotographic developer, the ferrite core material having a ferrite particle composition represented by the formula (1) shown below, containing SrO replacing a part of (MnO) and/or (MgO) in the formula (1) shown below, and having a Cl concentration of 0.1 to 100 ppm, as measured by an elution method of the ferrite core material.

$$(MnO)x(MgO)y(Fe_2O_3)z \quad (1)$$

wherein x=35 to 45 mol %, y=5 to 15 mol %, z=40 to 60 mol %, and x+y+z=100 mol %.

The ferrite core material for an electrophotographic developer described above according to the present invention desirably contains a replacement amount of SrO of 0.1 to 2.5 mol %.

The ferrite core material for an electrophotographic developer described above according to the present invention desirably has a BET specific surface area of the ferrite particle of 0.1 to 0.185 $m^2/g$.

The ferrite core material for an electrophotographic developer described above according to the present invention desirably has a shape factor SF-1 of the ferrite particle of 100 to 120.

The ferrite core material for an electrophotographic developer described above according to the present invention desirably has an electric resistance of the ferrite particle of $1\times10^6$ to $1\times10^9\Omega$ as measured at normal temperature and normal humidity.

The ferrite core material for an electrophotographic developer described above according to the present invention desirably has a volume-average particle diameter of the ferrite particle of 20 to 50 μm, a magnetization at application of 1 kOe of 50 to 70 $Am^2/kg$, a particle density of 4.0 to 5.5 $g/cm^3$ and an apparent density of 1.5 to 2.5 $g/cm^3$, and desirably contains 5% by volume or less of particles of less than 24 μm.

The ferrite core material for an electrophotographic developer described above according to the present invention desirably has a magnetization of the ferrite particle at application of 500 Oe of 30 to 50 $Am^2/kg$.

The present invention further provides a ferrite carrier for electrophotography prepared by coating a surface of the ferrite core material described above with a resin.

The present invention further provides an electrophotographic developer comprising the ferrite carrier described above and a toner.

The electrophotographic developer described above according to the present invention can also be used as a refill developer.

The ferrite core material for an electrophotographic developer according to the present invention is a ferrite having a specific composition, and has a desired high chargeability and little environmental variation in the charge amount because the Cl concentration is suppressed within a certain range. A carrier for an electrophotographic developer using the ferrite core material also has a high chargeability which can be maintained over a long period, and exhibits little environmental variation.

DETAILED DESCRIPTION OF THE EMBODIMENTS

Hereinafter, embodiments according to the present invention will be described.

<The Carrier Core Material and the Ferrite Carrier for an Electrophotographic Developer According to the Present Invention>

In the present invention, the Cl concentration of the ferrite core material as measured by an elution method needs to be 0.1 to 100 ppm. The present invention relates to a ferrite having a specific composition as described later, but since if much of chlorides and chloride ions are present on the ferrite particle surface, a carrier and a developer are liable to adsorb moisture (water molecules) present in the use environment, the presence of large amounts thereof makes large the environmental variation in electric properties including the charge amount. Chlorides and chloride ions need to be decreased as much as possible.

However, as iron oxide as one of ferrite raw materials, use of an iron oxide by-produced from the hydrochloric acid pickling step carried out in steel production is common, and the iron oxide contains chlorides and chloride ions as inevitable impurities. Although most part of the chlorides and chloride ions are removed in a high-temperature treatment in a sintering step as one of ferrite production steps, a part thereof comes to remain. Particularly in the case where a ferrite particle having a relatively large specific surface area is produced in order to enhance the chargeability, the sintering temperature needs to be set rather low, and thus chlorides and chloride ions are liable to remain.

Additionally, if the BET specific surface area is made large in order to enhance the chargeability, the ferrite particle contains more chlorides and/or chloride ions remaining on the core material particle surface than ferrite particles used for common resin-coated ferrites, and thus carrier properties are greatly affected.

Therefore, in the present invention, as described above, the Cl concentration of a ferrite core material measured by an elution method of the ferrite core material needs to be 0.1 to 100 ppm. The Cl concentration is desirably 0.1 to 70 ppm, more desirably 0.1 to 50 ppm, and most desirably 0.1 to 20 ppm. If the Cl concentration exceeds 100 ppm, moisture (water molecules) present in the use environment is liable to be adsorbed as described above, and thus the environmental variation in electric properties including the charge amount becomes larger, which is not preferable.

Making the Cl concentration less than 0.1 ppm is industrially difficult. As raw materials generally used for ferrites and ferrite carriers for electrophotographic developers, particularly a raw material containing much of Cl is iron oxide. This is because as iron oxide, use of an iron oxide by-produced from the hydrochloric acid pickling step carried out in steel production is industrially common. Such an iron oxide includes ones of some grades, but contains several hundred ppm of Cl. Even iron oxide industrially used and containing the least of Cl contains about 200 ppm of Cl.

Here, the ferrite according to the present invention is represented by the general formula (1) shown below, and a part of (MnO) and/or (MgO) in the formula (1) shown below is replaced by SrO.

$$(MnO)x(MgO)y(Fe_2O_3)z \quad (1)$$

wherein x=35 to 45 mol %, y=5 to 15 mol %, z=40 to 60 mol %, and x+y+z=100 mol %.

In order to obtain desired magnetic properties and in order to obtain a ferrite exhibiting stable properties even over time, z is preferably 40 mol % or more. In this case, though depending on amounts of MnO and MgO, $Fe_2O_3$ is 50% by weight or more in weight ratio.

If an iron oxide raw material containing industrially the least of Cl is used for such a ferrite containing 50% by weight or more of $Fe_2O_3$, about 125 ppm of Cl comes to be present in the ferrite composition. Actually, since the ferrite composition is heated at a high temperature in a calcination step and a regular sintering step, a part of the Cl is removed, and all of the Cl does not remain in the ferrite. However, in order to make the Cl concentration less than 0.1 ppm, there are needs of using a high-purity iron oxide raw material and sintering it at a high temperature, and thus the cost rises and it becomes difficult to obtain a ferrite particle having a relatively large specific surface area necessary in the present invention.

There are various types of methods of measuring the Cl concentration. An example thereof is a method of using an X-ray fluorescence element analyzer, as described, for example, in Japanese Patent Laid-Open No. 2006-267345. However, the method of measuring the Cl concentration by an X-ray fluorescence element analyzer is an effective method for measuring not only Cl present in the vicinity of the surface but also directly Cl present in the particle interior which is not affected by the external environment. In the present invention, it has been found that especially Cl present in the vicinity of the surface causes an interaction with moisture in the air, thereby adversely affecting the environmental variation in the charge properties, and it has been further found that chlorides on the surface are influenced by moisture, and such chlorides are liable to come off, thereby decreasing the chargeability itself, and these facts basically have no relation with Cl present in the particle interior. Therefore, in the present invention, specifying and controlling the Cl concentration present on the ferrite particle surface is very important. As such a measurement method, an elution method described below is used.

[Cl Concentration: the Elution Method]

(1) 50.000 g+0.0002 g or less of a sample is accurately weighed, and put in a 150-ml glass bottle.

(2) 50 ml of a phthalate salt (pH: 4.01) is added to the glass bottle.

(3) 1 ml of an ion strength regulator is then added to the glass bottle, and the lid is closed.

(4) The mixture is stirred for 10 min by a paint shaker.

(5) The mixture is filtered to a 50-ml PP-made vessel by using a No. 5B filter paper while taking caution so that the carrier does not drop by laying a magnet on the bottom of the 150-ml glass bottle.

(6) An obtained supernatant is measured for the voltage by a pH meter.

(7) Solutions having different Cl concentrations (pure water, 1 ppm, 10 ppm, 100 ppm and 1,000 ppm) fabricated for a calibration curve are similarly measured, and the Cl concentration of the sample is calculated from these values.

The ferrite core material is represented by the general formula (1) shown below, and a part of (MnO) and/or (MgO) in the formula (1) shown below is replaced by SrO.

$$(MnO)x(MgO)y(Fe_2O_3)z \quad (1)$$

wherein x=35 to 45 mol %, y=5 to 15 mol %, z=40 to 60 mol %, and x+y+z=100 mol %.

Here, the case of a composition in which x is less than 35 mol %, and MgO is more than 15 mol % cannot enhance the magnetization of a ferrite, and causes carrier scattering, which is not preferable. Although the case of a composition in which x is more than 45 mol %, and y is less than 5 mol % can enhance the magnetization, since the amount of MgO, which has a high electronegativity, contained in a ferrite core material is small, the case causes a reduction in the charge amount of the ferrite core material, which is not preferable.

In the case of a composition in which MgO described in Japanese Patent Laid-Open No. 2006-267345 is 40 mol %, and $Fe_2O_3$ thereof is 60 mol %, the magnetization is remarkably low, and thus the composition causes carrier scattering, which is not preferable.

In consideration of the recent tendency of the environmental load reduction including the waste regulation, heavy metals of Cu, Zn and Ni are not preferably contained in amounts exceeding the ranges of inevitable impurities (accompanying impurities).

The composition of the ferrite core material contains SrO. Ferrite particles having a composition like the formula (1) shown above sometimes generate low-magnetization particles in the production process, causing carrier scattering. However, as in the present invention, making SrO contained can suppress the generation of low-magnetization particles.

SrO forms, with $Fe_2O_3$, precursors (hereinafter, referred to as Sr—Fe compounds) of a ferrite of a magnetoplumbite type having a form of (SrO).6($Fe_2O_3$), and a strontium ferrite having a crystal structure of the cubic system and a perovskite type represented by $Sr_aFe_bO_c$ (wherein a≧2, and a+b≦c≦a+1.5b), and forms solid solutions with (MnO)x(MgO)y($Fe_2O_3$)z having a spinel structure. This composite oxide of iron and strontium has an effect of raising the chargeability of a ferrite core material conjointly mainly with a magnesium ferrite as a component containing MgO. Particularly Sr—Fe compounds have a crystal structure similar to that of $SrTiO_3$, which has a high permittivity, and contributes to a high chargeability of a core material.

In such a way, the ferrite particle according to the present invention contains Mg and Sr as essential components to raise the chargeability, and most of Mg and Sr are present in a spinel structure, a magnetoplumbite structure and/or their precursors. However, a part of these elements is liable to combine with chlorine to form chlorides. Particularly, since the magnetoplumbite structure described above has a lower production rate than the spinel structure, the magnetoplumbite structure is liable to combine with chlorine which has not been completely removed to form a chloride (strontium chloride) in a sintering process of a ferrite.

A Sr—Fe compound having a lower oxygen concentration is more easily produced, and a core material containing a lower amount of chlorine is more easily produced because of less oxidation of Fe by chlorine. By contrast, the case of much chlorine easily produces a strontium ferrite because Fe is easily oxidized even if the oxygen concentration is low in sintering.

In the ferrite core material for an electrophotographic developer described above according to the present invention, the proportion (%) of the strontium ferrite in the whole of Sr—Fe compounds contained in the particle preferably satisfies the range described below.

$$0 \leqq A/(A+B) \leqq 0.8$$

A: the content (% by weight) of the strontium ferrite
B: the Sr—Fe compounds (% by weight)

The proportion described above is preferably 0 to 0.8, as indicated in the formula shown above, but more preferably 0 to 0.7, and most preferably 0 to 0.6.

The content (% by weight) of the strontium ferrite and the content (% by weight) of the Sr—Fe compounds can be calculated from analysis results of X-ray diffraction.

(Measurement of the Crystal Structure: X-Ray Diffractometry)

As a measurement apparatus, "X'PertPRO MPD", made by PANalytical B.V., was used. As an X-ray source, a Co tube (CoKα line) was used; as an optical system, an integrated optical system and a high-speed detector "X'Celarator" were used; and the measurement was carried out at a continuous scanning of 0.2°/sec. The measurement result was data processed using analysis software "X'Pert HighScore" as in the usual analysis of crystal structures of powder to identify the crystal structure, and the obtained crystal structure was refined to calculate the presence ratio in terms of weight. In calculation of the presence ratio, since separation of peaks of a magnesium ferrite and a manganese ferrite is difficult, these were treated as a spinel phase, and respective presence ratios of crystal structures other than these were calculated. For the identification of the crystal structures, O was defined as an essential element, and Fe, Mn, Mg and Sr were defined as elements which had a possibility of being present. With respect to an X-ray source, the measurement can be carried out by a Cu tube with no problem, but since in the case of a sample containing much Fe, the background becomes larger than peaks of measurement objects, use of a Co tube is more preferable. With respect to an optical system, a parallel method may provide the similar result, but since the intensity of X-rays is low and the measurement takes much time, the measurement by an integrated optical system is preferable. The speed of the continuous scanning is not especially limited, but in order to obtain a sufficient S/N ratio when the crystal structures were analyzed, the peak intensity of the (113) plane giving the main peak of a spinel structure was made to become 50,000 cps or more, and the measurement was carried out by setting a carrier core material in a sample cell such that the particles did not orient in a specific preferential direction.

Since chlorides of Mg and Sr are liable to be present on the ferrite particle surface, moisture (water molecules) in the air is easily adsorbed, and the charge amount becomes liable to vary due to the environmental variation. Since Mg and Sr functioning to enhance the chargeability of a ferrite core material due to the presence of these as a part of a ferrite composition are present as chlorides on the surface, the chlorides easily come off by being stirred with a toner, thus causing a decrease in the charge amount.

Further, chlorine ions and chlorides described above move from the surface of the carrier to the surface of a toner when stirred with the toner, and contaminate the toner surface. Such a contamination causes a decrease in the charge amount.

For the reasons as described above, the amount of chlorine present on the surface of a ferrite particle having a specific composition needs to be exactly controlled, and thereby, a carrier for an electrophotographic developer providing a large charge amount and moreover exhibiting little variation in the charge amount against the environmental variation can be provided.

In the ferrite core material for an electrophotographic developer described above according to the present invention, the replacement amount of SrO is desirably 0.1 to 2.5 mol %.

If the replacement amount of SrO is less than 0.1 mol %, the effect of making SrO contained as described above is small, which is not preferable. If the replacement amount of SrO is more than 2.5 mol %, the residual magnetization and the coercive force rise and reduce the fluidity of a carrier, thereby worsening mixability with a toner, which is not preferable. The amount of SrO is preferably 0.1 to 2.0 mol %, and more preferably 0.3 to 1.5 mol %.

In the ferrite core material for an electrophotographic developer described above according to the present invention, the content of Si is desirably 0.2% or less.

If the content of Si is more than 0.2%, possibly the electric resistance at the grain boundary of a ferrite particle is liable to rise to suppress the movement of a charge, and thus the chargeability is liable to decrease. Further since the grain boundary of the ferrite particle surface is liable to become nonuniform, and it becomes difficult to stably obtain desired charge properties, the effect of exactly controlling the Cl concentration as described above can hardly be obtained. The content of Si is preferably less than 0.18%, and more preferably less than 0.15%.

[Content of Si]

A measurement apparatus, ZSX100s made by Rigaku Corp. was used. About 5 g of a sample is put in a vacuum-use powder sample container, and set on a sample holder, and measured for Si by the measurement apparatus described above.

Here, the measurement conditions for Si were: a Si-Kαline as a measurement line, a tube voltage of 50 kV, a tube current of 50 mA, PET as a dispersive crystal, and PC (proportional counter) as a detector.

In the ferrite core material for an electrophotographic developer described above according to the present invention, the BET specific surface area of a ferrite particle is desirably 0.1 to 0.185 $m^2/g$, more desirably 0.1 to 0.165 $m^2/g$, and most desirably 0.115 to 0.165 $m^2/g$.

If the value of a BET specific surface area is less than 0.1 $m^2/g$, an effective charge area becomes small, thereby causing a decrease in the chargeability. If the value of a BET surface area is more than 0.185 $m^2/g$, the particle shape is likely to be degraded, thereby causing image faults such as carrier scattering, which is not preferable.

[BET Specific Surface Area]

Here, the BET specific surface area was measured using a BET specific surface area measurement apparatus (MacSorb HM model 1210) made by Mountech Co., Ltd. A measurement sample was placed in a vacuum drier to be subjected to a treatment at 200° C. for 2 hours, and held in the drier until the temperature becomes 80° C. or lower, and then taken out from the drier. Thereafter, the sample was filled closely in a cell, and the cell was set in the apparatus. The sample was subjected to a pretreatment at a degassing temperature of 200° C. for 60 min, and then measured.

In the ferrite core material for an electrophotographic developer described above according to the present invention, the pore volume of the ferrite particle is desirably less than 0.03 ml/g.

If the pore volume of the ferrite particle is 0.03 ml/g or more, possibly moisture in the air becomes liable to be adsorbed in a ferrite core material, and thus the environmental variation in the charge amount is liable to become large. Further, since a resin is impregnated in the ferrite particle interior when resin coating is carried out, the electric resistance after the resin coating is liable to become low. Therefore, in order to raise the electric resistance after the resin coating, a large amount of the resin needs to be used, which is not preferable. The pore volume of the ferrite particle is preferably less than 0.02 ml/g.

[Pore Volume of the Ferrite Particle]

The measurement of the pore volume of the ferrite particle was carried out as follows. That is, the pore diameter was measured using mercury porosimeters Pascal 140 and Pascal 240 (made by Thermo Fisher Scientific Inc.). As a dilatometer, CD3P (for powder) was used. A sample was put in a commercially available gelatin-made capsule having a plurality of bores opened, which was then placed in the dilatometer. After the sample was degassed in Pascal 140, mercury was filled and a low-pressure region (0 to 400 kPa) was measured. Thereafter, the total weight of the dilatometer, the mercury, the capsule and the sample was measured. Then, a high-pressure region (0.1 MPa to 200 MPa) was measured using Pascal 240. After the measurement, the pore volume of the ferrite particle was determined from data (the pressure and the amount of mercury pressed in) for pore diameters of 3 μm or less converted from pressure. For determining the pore diameters, control-cum-analysis software coming with the porosimeter, PASCAL 140/240/440, was used, and the calculation was carried out with the surface tension of mercury set at 480 dyn/cm and the contact angle set at 141.3°.

In the ferrite core material for an electrophotographic developer described above according to the present invention, the shape factor SF-1 of the ferrite particle is preferably 100 to 120.

Since the shape factor SF-1 is 100 in the case where the ferrite particle is a perfect sphere, the shape factor SF-1 never becomes less than 100. If the shape factor SF-1 exceeds 120, the particle shape is likely to deteriorate, thereby causing image faults such as carrier scattering, which is not preferable.

[Shape Factor SF-1]

Here, the shape factor of particles is a value obtained as follows: the particles were dispersed so as not to overlap each other and a carrier SEM was taken for 450X visual fields using JSM-6060A, made by JEOL Ltd., at an acceleration voltage of 20 kV; the image information is introduced to image analysis software (Image-Pro PLUS), made by Media Cybernetics Inc., through an interface, and analyzed to determine an Area and a Feret diameter (maximum); and from these values, the shape factor SF-1 was calculated by the formula shown below. The shape factor SF-1 of a carrier having a shape closer to a spherical shape is a value closer to 100. The shape factor SF-1 was calculated for every one particle, and an average value of 100 particles was defined as a shape factor SF-1 of the carrier.

$$SF\text{-}1=(R^2/S)\times(\pi/4)\times 100$$

R: Feret diameter (maximum), S: Area

In the ferrite core material for an electrophotographic developer described above according to the present invention, the electric resistance of the ferrite particle measured at normal temperature and normal humidity is desirably $1\times10^6$ to $1\times10^9\Omega$, more desirably $1\times10^7$ to $1\times10^9\Omega$, and most desirably $2\times10^7$ to $5\times10^8\Omega$.

If the electric resistance at normal temperature and normal humidity is less than $1\times10^6\Omega$, the charge leaks, thereby causing occurrence of white spots in an image and causing carrier scattering, which is not preferable. If the electric resistance exceeds $1\times10^9\Omega$, when the carrier core material after resin coating is mixed with a toner, the time until the charge amount reaches a saturation value is elongated, and toner scattering is liable to be caused right after toner refill, which is not preferable.

[Electric Resistance at Normal Temperature and Normal Humidity]

Here, the electric resistance was measured as follows: non-magnetic parallel flat plate electrodes (10 mm×40 mm) were opposed to each other with an electrode interval of 6.5 mm, and 200 mg of a sample was weighed and filled therebetween; and magnets (surface magnetic flux density: 1,500 Gauss, the area of the magnets brought into contact with the electrodes: 10 mm×30 mm) were attached to the parallel flat plate electrodes to hold the sample between the electrodes; and a voltage of 1,000 V was impressed, and the electric resistance was measured by an insulation resistance tester (SM-8210, made by DKK-TOA Corp.). "At normal temperature and normal humidity" used here referred to "under the environment of a room temperature of 20 to 25° C. and a humidity of 50 to 60%", and the above-mentioned measurement was carried out after a sample was exposed in a thermohygrostat chamber whose temperature and humidity were controlled at the room temperature and the humidity described above for 12 hours or longer.

The above-mentioned electric resistance regards a value at normal temperature and normal humidity, but it is needless to say that it is better that the resistance difference is as small as possible between at a high-temperature and a high-humidity (hereinafter, H/H environment), at normal temperature and normal humidity (hereinafter, N/N environment) and at a low-temperature and a low-humidity (hereinafter, L/L environment). Particularly a decrease in the resistance at a H/H environment causes occurrence of white spots, and carrier scattering due to a low resistance. A decrease in the resistance in a low-electric field side which decrease means a decrease in the resistance in the vicinity of the surface lets the charge accumulated over the entire core material easily escape, and directly leads to image faults such as fogging and toner scattering. In order to avoid the occurrence of image faults caused by these environmental variations, making high the resistance in the vicinity of the surface is preferable, and for making the vicinity of the surface of a high resistance, a surface oxidation treatment is effective.

The resistance under a H/H environment (hereinafter, H/H resistance) is preferably $1\times10^5$ to $1\times10^8\Omega$. Since the case where the H/H resistance is less than $1\times10^5\Omega$ causes occurrence of white spots, and carrier scattering due to a low resistance, a good image under the H/H environment cannot be obtained, which is not preferable. The case where the H/H resistance is higher than $1\times10^8\Omega$ makes a higher resistance under an N/N environment and under an L/L environment, and there are possibilities of causing image faults such as white spots due to a high resistance and a decrease in image density due to charge-up under an N/N environment and under an L/L environment, which is not preferable.

A more preferable range of the H/H resistance is $1\times10^6$ to $1\times10^8\Omega$, and a most preferable range thereof is $5\times10^6$ to $1\times10^8\Omega$.

[Electric Resistance Under the H/H Environment]

After a sample was exposed for 12 hours or longer in a chamber whose room temperature and humidity were controlled under a H/H environment of a temperature of 30 to 35° C. and a relative humidity of 80 to 85%, the electric resistance was measured by the same method as the electric resistance at normal temperature and normal humidity as described above. At this time, the interval between electrodes was set at 2.0 mm, and the applied voltage was set at 50 V.

The ferrite core material for an electrophotographic developer described above according to the present invention desirably has a volume-average particle diameter of the ferrite particle of 20 to 50 μm, a magnetization at application of 1 kOe of 50 to 70 $Am^2/kg$, a particle density of 4.0 to 5.5 $g/cm^3$ and an apparent density of 1.5 to 2.5 $g/cm^3$, and desirably contains 5% by volume or less of particles of less than 24 μm.

If the average particle diameter of a ferrite core material is less than 20 μm, carrier scattering is liable to occur, and if that exceeds 50 μm, the image quality is reduced, which are not preferable.

If the magnetization at application of 1 kOe of a ferrite core material is less than 50 $Am^2/kg$, carrier scattering is liable to occur; and if that exceeds 70 $Am^2/kg$, the magnetic brush becomes too hard, thereby causing the deterioration of the image quality. The saturation magnetization is more desirably 55 to 65 $Am^2/kg$.

If the particle density of a ferrite core material is less than 4.0 $g/cm^3$, the fluidity of the carrier deteriorates, and if that exceeds 5.5 $g/cm^3$, the ferrite core material strongly receives a stirring stress in a developing machine, thereby causing the deterioration of charge properties, which are not preferable. The particle density is more desirably 4.3 to 5.3 $g/cm^3$, and most desirably 4.5 to 5.0 $g/cm^3$.

[Particle Density]

The particle density was measured as follows. That is, the particle density was measured using a picnometer according to JIS R9301-2-1. Here, as a solvent, methanol was used, and the measurement was carried out at a temperature of 25° C.

If the apparent density of a ferrite core material is less than 1.5 $g/cm^3$, the fluidity of the carrier deteriorates, and if that exceeds 2.5 $g/cm^3$, the ferrite core material strongly receives a stirring stress in a developing machine, thereby causing the deterioration of charge properties, which are not preferable. The apparent density is more desirably 1.8 to 2.4 $g/cm^3$, and most desirably 2.1 to 2.4 $g/cm^3$.

[Apparent Density]

The apparent density was measured according to JIS-Z2504 (Metallic powders—Determination of apparent density—Funnel method).

If particles less than 24 μm exceed 5% by volume, carrier scattering is liable to occur, which is not preferable. Particles less than 24 μm are more desirably 4% by volume or less, and most desirably 3% by volume or less.

[Volume-Average Particle Diameter and the Amount of Particles Less Than 24 μm (MicroTrack)]

The average particle diameter and the amount of particles less than 24 μm were measured as follows. That is, these were measured using a MicroTrack particle size analyzer (Model: 9320-X100), made by Nikkiso Co., Ltd. As a solvent, water was used. 10 g of a sample and 80 ml of water were put in a 100-ml beaker, and 2 or 3 drops of a dispersant (sodium hexametaphosphate) were added thereto. Then, the mixture was dispersed for 20 sec using an ultrasonic homogenizer (UH-150 type, made by SMT Co., Ltd.) at an output power level set at 4. Thereafter, bubbles generated on the surface in the beaker were removed, and the sample was loaded in the analyzer.

In the ferrite core material for an electrophotographic developer described above according to the present invention, the magnetization at application of 500 Oe of the ferrite core material is desirably 30 to 50 $Am^2/kg$.

If the magnetization at application of 500 Oe of the ferrite core material is less than 30 $Am^2/kg$, carrier scattering is liable to occur; and if that exceeds 50 $Am^2/kg$, the magnetic brush becomes too hard, thereby causing the deterioration of the image quality.

[Magnetizations at application of 1 kOe and 500 Oe]

The measurement of the magnetization used a vibrating sample-type magnetometer (model name: VSM-C7-10A, made by Toei Industry Co., Ltd.). A measurement sample was filled in a cell of 5 mm in inner diameter and 2 mm in height, and set on the magnetometer described above. The measurement was carried out by impressing a magnetic field and sweeping the impressing magnetic field to 1 kOe. Then, the impressed magnetic field was reduced and a hysteresis curve was fabricated. The magnetization was determined from data of the curve. In the case of measuring the magnetization at 500 Oe, the impressing magnetic field was swept to 500 Oe.

The carrier for an electrophotographic developer according to the present invention is desirably surface-treated with a coating resin on the surface of the ferrite core material described above. Carrier properties, particularly electric properties including charge properties, are influenced by materials and properties present on the carrier surface in many cases. Therefore, surface-coating with a suitable resin can regulate desired carrier properties with high precision.

The coating resin is not especially limited, but examples thereof include fluoro resins, acrylic resins, epoxy resins, polyamide resins, polyamide imide resins, polyester resins, unsaturated polyester resins, urea resins, melamine resins, alkyd resins, phenol resins, fluoroacrylic resins, acryl-styrene resins, silicone resins, and modified silicone resins modified with resins such as acrylic resins, polyester resins, epoxy resins, polyamide resins, polyamide imide resins, alkyd resins, urethane resins and fluoro resins. In consideration of coming-off of the resin due to the mechanical stress during usage, a thermosetting resin is preferably used. The thermosetting resin specifically includes epoxy resins, phenol resins, silicone resins, unsaturated polyester resins, urea resins, melamine resins, alkyd resins and resins containing them. The amount of a resin applied is preferably 0.5 to 5.0 parts by weight with respect to 100 parts by weight of a ferrite core material (before resin coating).

The coating resin may comprise a charge control agent. Examples of the charge control agent include various types of charge control agents commonly used for toners, and various types of silane coupling agents. This is because in the case of coating with a large amount of a resin, the charging capability may decrease, but addition of various types of charge control agents and silane coupling agents can control the charging capability. The types of charge control agents and coupling agents usable are not especially limited, but are preferably a charge control agent such as nigrosine dyes, quaternary ammonium salts, organic metal complexes or metal-containing monoazo dyes, and an aminosilane coupling agent, a fluorine-based silane coupling agent or the like.

Use of negatively chargeable toners has been in the mainstream in recent years, so carriers need to be positively chargeable. Highly positively chargeable materials include amine compounds. Amine compounds are highly positively chargeable, and are effective materials because they can make toners of a sufficiently negative polarity.

As such amine compounds, various types thereof can be used. Examples thereof include aminosilane coupling agents, amino-modified silicone oils and quaternary ammonium salts.

Among such amine compounds, especially aminosilane coupling agents are suitable. The reason includes: an aminosilane coupling agent can be used together with relatively many types of resins; when used with a resin, an aminosilane coupling agent is effective in improving the adhesivity of a ferrite core material and a coating resin; adjustment of the addition amount can easily regulate charge properties; and since an aminosilane coupling agent has high positive chargeability, even a small amount thereof can be used to make a toner of a sufficiently negative polarity.

As an aminosilane coupling agent, any of a primary amine, a secondary amine, and a compound containing the both can be used. Examples that are suitably used are N-2-aminoethyl-3-aminopropylmethyldimethoxysilane, N-2-aminoethyl-3-aminopropyltrimethoxysilane, N-2-aminoethyl-3-aminopropyltriethoxysilane, N-aminopropyltrimethoxysilane, N-aminopropyltriethoxysilane, 3-triethoxysilyl-N-(1,3-dimethyl-butylidene)propylamine and N-phenyl-3-aminopropyltrimethoxysilane.

In the case where an amine compound is used as a mixture with a resin, the amine compound is desirably contained in 2 to 50% by weight in a coating resin solid content. The content of an amine compound of less than 2% by weight does not have the containing effect; and even the content of more than 50% by weight can provide no larger effect, which is economically disadvantage. The case of an excess amount of an amine compound sometimes causes trouble in compatibility with a coating resin and in others, and is liable to make an inhomogeneous resin mixture, which is not preferable.

Besides addition and use of an amine compound as described above to a coating resin as a base, a base resin may be modified with an amino group in advance. Such examples are amino-modified silicone resins, amino group-containing acryl resins, amino group-containing epoxy resins and the like. These resins may be used singly or as a mixture with other resins. In the case of using a resin containing a modified amino group, or a mixture of a resin containing a modified amino group with another resin, the amount of the amino group present in the whole resin is suitably determined from their chargeability, compatibility and the like.

In order to control the electric resistance, the charge amount and the charging rate of a carrier, a conductive agent, other than the charge control agent as described above, may be added in a coating resin. Since the conductive agent itself has a low electric resistance, an excess addition amount thereof is liable to cause rapid charge leakage. Therefore, the addition amount is 0.25 to 20.0% by weight, preferably 0.5 to 15.0% by weight, and especially preferably 1.0 to 10.0% by weight, with respect to the solid content of the coating resin. The conductive agent includes conductive carbon, oxides such as titanium oxide and tin oxide, and various types of organic conductive agents.

<Production Method of the Carrier for an Electrophotographic Developer According to the Present Invention>

A method for producing the carrier for an electrophotographic developer according to the present invention will be described.

In a method for producing the carrier for an electrophotographic developer according to the present invention, for producing a ferrite core material, raw materials are first weighed in proper amounts, and then the raw materials are pulverized and mixed for 0.5 hour or longer, preferably 1 to 20 hours with a ball mill, a vibration mill or the like. The raw materials are not especially limited, but desirably selected so as to make a composition containing elements described before.

After the pulverized material thus obtained is pelletized using a compression molding machine or the like, the pellet is calcined at a temperature of 700 to 1,300° C. Without using a compression molding machine, after the pulverization, water may be added to the pulverized material to make a slurry, which may be then granulated using a spray drier. After the calcination, the calcined pellet is further pulverized by a ball mill, a vibration mill or the like, and thereafter, water and as required, a dispersant, a binder and the like are added thereto; and after the viscosity regulation, the mixture is granulated by converting it into a granular form with a spray drier. In the pulverization after the calcination, the pulverization may be carried out by a wet ball mill, a wet vibration mill or the like after water is added.

The pulverizer such as a ball mill or a vibration mill described above is not especially limited, but in order to disperse raw materials effectively and homogeneously, use of fine beads having a particle diameter of 1 mm or less as a medium to be used is preferable. By adjusting the diameter, composition and pulverization time of the beads to be used, the degree of pulverization can be controlled.

Thereafter, the obtained granulated material is held under an atmosphere in which an oxygen concentration is controlled, at a temperature of 800 to 1,500° C. for 1 to 24 hours to regularly sinter the granulated material. At this time, a rotary electric furnace, a batch type electric furnace, a continuous electric furnace or the like is used, and with respect to the atmosphere at sintering, an inert gas such as nitrogen, and a reducing gas such as hydrogen or carbon monoxide may be charged to control the oxygen concentration.

A sintered material thus obtained is pulverized and classified. The sintered material is size-regulated to a desired particle diameter using a classification method such as an existing air classification, a mesh filtration method or a precipitation method.

Thereafter, as required, the surface may be subjected to an oxide film treatment by low-temperature heating to regulate the electric resistance. The oxide film formation uses a common rotary electric furnace, batch type electric furnace or the like, which can carry out a thermal treatment, for example, at 300 to 700° C. The thickness of the oxide film formed by this treatment is preferably 0.1 nm to 5 μm. With the thickness less than 0.1 nm, the effect of an oxide film layer is small; and with the thickness exceeding 5 μm, the magnetization decreases and the resistance becomes too high, and thus desired properties can hardly be obtained, which is not preferable. As required, before the oxide film treatment, reduction may be carried out. In such a way, the ferrite core material according to the present invention is prepared.

Methods for regulating the Cl concentration of a ferrite core material include various types of methods. Examples thereof include methods of: using raw materials originally containing a low Cl concentration; sufficiently heating in a calcination step and/or a regular sintering step; and in order to efficiently remove Cl in these steps, introducing some gas (air, nitrogen or the like) in the furnace, or using an exhaust fan or the like installed in the furnace outlet port to make a gas flow in the furnace to exhaust Cl with the gas out of the furnace. Also, as required, heating steps are carried out two or more times. This is a method in which sintering is carried out at a low temperature of 1,200° C. or lower in the regular sintering step in order to form a ferrite having a relatively large specific surface area, and thereafter, heating is again carried out to remove Cl. In this case, in the reheating, heating is carried out at a sufficiently lower temperature than in the regular sintering, for example, at about 900° C. Thereby, only Cl present in the vicinity of the ferrite particle surface can be removed while the desired specific surface area and surface properties regulated in the regular sintering step are maintained.

As described above, it is desirable that after a ferrite core material is fabricated, the surface of the ferrite core material is coated with a resin. Carrier properties, especially electric properties including charge properties, are often influenced by materials and properties present on the carrier surface. Therefore, by coating the surface with a proper resin, desired carrier properties can be regulated with high precision. As a coating method is there a well-known method, for example, a brush coating method, a dry method, a spray dry system using a fluidized bed, a rotary dry system, and a dip-and-dry method using a universal stirrer, and the coating can be carried out by the one method. In order to improve the surface coverage, the method using a fluidized bed is preferable. In the case where after the resin coating, baking is carried out, the baking may be carried out using either of an external heating system and an internal heating system, for example, a fixed or fluidized electric furnace, a rotary electric furnace, a burner furnace and a microwave system. In the case of using a UV curing resin, a UV heater is used. The baking temperature is different depending on a resin to be used, but needs to be a temperature equal to or higher than the melting point or the glass transition point; and for a thermosetting resin, a condensation-crosslinking resin or the like, the temperature needs to be raised to a temperature at which the curing proceeds sufficiently.

<The Electrophotographic Developer According to the Present Invention>

Then, the electrophotographic developer according to the present invention will be described.

The electrophotographic developer according to the present invention comprises the above-mentioned carrier for an electrophotographic developer, and a toner.

The toner particle constituting the electrophotographic developer according to the present invention includes a pulverized toner particle produced by a pulverizing method and a polymerized toner particle produced by a polymerizing method. In the present invention, the toner particles obtained by either of the methods can be used.

The pulverized toner particle can be obtained by sufficiently mixing, for example, a binding resin, a charge control agent and a colorant by a mixer such as a Henschel mixer, then melting and kneading the mixture by a twin-screw extruder or the like, cooling, then pulverizing and classifying the extruded material, and adding external additives to the classified material, and then mixing the mixture by a mixer or the like.

The binding resin constituting the pulverized toner particle is not especially limited, but includes polystyrene, chloropolystyrene, styrene-chlorostyrene copolymers, styrene-acrylate copolymers, styrene-methacrylic acid copolymers, and additionally rosin-modified maleic resins, epoxy resins, polyester resins and polyurethane resins. These are used singly or as a mixture thereof.

Any charge control agent can be used. Examples of a positively chargeable toner include nigrosine dyes and quaternary ammonium salts; and examples of a negatively chargeable toner include metal-containing monoazo dyes.

As the colorant (coloring agent), a conventionally known dye and pigment can be used. For example, carbon black, phthalocyanine blue, Permanent Red, chrome yellow, phthalocyanine green and the like can be used. Besides, external additives, such as silica powder and titania, to improve the fluidity and aggregation resistance of a toner may be added depending on the toner particle.

The polymerized toner particle is a toner particle produced by a well-known method such as a suspension polymerization method, an emulsion polymerization method, an emulsion aggregation method, an ester extension polymerization method or a phase transition emulsion method. Such a polymerized toner particle is obtained, for example, by mixing and stirring a colored dispersion liquid in which a colorant is dispersed in water using a surfactant, a polymerizable monomer, a surfactant and a polymerization initiator in an aqueous medium to emulsify and disperse the polymerizable monomer in the aqueous medium and then polymerize the monomer under stirring and mixing, thereafter adding a salting-out agent to salt out a polymer particle. The particle thus obtained is filtered, washed and dried to obtain the polymerized toner particle. Thereafter, as required, external additives are added to the dried toner particle.

When the polymerized toner particle is produced, in addition to the polymerizable monomer, the surfactant, the polymerization initiator and the colorant, a fixation improving agent and a charge control agent may be blended, whereby various properties of a polymerized toner particle thus obtained can be controlled and improved. In order to improve the dispersibility of the polymerizable monomer in the aqueous medium, and regulate the molecular weight of a polymer obtained, a chain transfer agent may be further used.

The polymerizable monomer used for production of the polymerized toner particle described above is not especially limited, but examples of the monomers include styrene and its derivatives, ethylenic unsaturated monoolefins such as ethylene and propylene, halogenated vinyls such as vinyl chloride, vinyl esters such as vinyl acetate, and α-methylene aliphatic monocarboxylate esters such as methyl acrylate, ethyl acrylate, methyl methacrylate, ethyl methacrylate, 2-ethylhexyl methacrylate, acrylic acid dimethyl amino ester and methacrylic acid diethyl amino ester.

The colorant (coloring material) usable in preparation of the polymerized toner particle described above is a conventionally known dye and pigment. For example, usable are carbon black, phthalocyanine blue, Permanent Red, chrome yellow, phthalocyanine green and the like. These colorants may be modified on their surface using a silane coupling agent, a titanium coupling agent or the like.

The surfactant usable in production of the polymerized toner particle is an anionic surfactant, a cationic surfactant, an amphoteric surfactant and a nonionic surfactant.

Here, the anionic surfactant includes fatty acid salts such as sodium oleate and castor oil, alkylsulfate esters such as sodium laurylsulfate and ammonium laurylsulfate, alkylbenzenesulfonate salts such as sodium dodecylbenzenesulfonate, alkylnaphthalenesulfonates, alkylphosphate salts, naphthalenesulfonic acid-formalin condensates and polyoxyethylene alkylsulfate salts. The nonionic surfactant includes polyoxyethylene alkyl ethers, polyoxyethylene fatty acid esters, sorbitan fatty acid esters, polyoxyethylene alkylamines, glycerin, fatty acid esters and oxyethylene-oxypropylene block polymers. Furthermore, the cationic surfactant includes alkylamine salts such as laurylamine acetate, and quaternary ammonium salts such as lauryltrimethylammonium chloride and stearyltrimethylammonium chloride. Then, the amphoteric surfactant includes aminocarboxylate salts and alkylamino acids.

A surfactant as described above can be used usually in an amount in the range of 0.01 to 10% by weight with respect to a polymerizable monomer. Since the use amount of such a surfactant influences the dispersion stability of a monomer, and also influences the environmental dependency of a polymerized toner particle obtained, the use thereof in the range described above is preferable in which range the dispersion stability of the monomer is secured and the environmental dependency of the polymerized toner particle is hardly excessively affected.

For production of a polymerized toner particle, a polymerization initiator is usually used. The polymerization initiator includes a water-soluble polymerization initiator and an oil-soluble polymerization initiator. In the present invention, either of them can be used. Examples of the water-soluble polymerization initiators usable in the present invention include persulfate salts such as potassium persulfate and ammonium persulfate, and water-soluble peroxide compounds. Examples of the oil-soluble polymerization initiators include azo compounds such as azobisisobutyronitrile, and oil-soluble peroxide compounds.

In the case of using a chain transfer agent in the present invention, examples of the chain transfer agents include mercaptans such as octylmercaptan, dodecylmercaptan and tert-dodecylmercaptan, and carbon tetrabromide.

Further in the case where a polymerized toner particle used in the present invention comprises a fixability improving agent, the fixability improving agent usable is natural waxes such as carnauba wax, and olefinic waxes such as polypropylene and polyethylene.

In the case where the polymerized toner particle used in the present invention comprises a charge control agent, the charge control agent to be used is not especially limited, and usable are nigrosine dyes, quaternary ammonium salts, organic metal complexes, metal-containing monoazo dyes, and the like.

External additives to be used for improving the fluidity and the like of a polymerized toner particle include silica, titanium oxide, barium titanate, fluororesin fine particles and acrylic resin fine particles. These may be used singly or in combination thereof.

The salting-out agent to be used for separation of a polymerized particle from an aqueous medium includes metal salts such as magnesium sulfate, aluminum sulfate, barium chloride, magnesium chloride, calcium chloride and sodium chloride.

The toner particle produced as described above has an average particle diameter in the range of 2 to 15 μm, and preferably 3 to 10 μm, and the polymerized toner particle has a higher uniformity of particles than the pulverized toner particle. If the toner particle is less than 2 μm in diameter, the chargeability decreases and fogging and toner scattering are liable to occur; and the toner particle exceeding 15 μm in diameter causes the deterioration of the image quality.

The carrier and the toner produced as described above may be mixed to obtain an electrophotographic developer. The mixing ratio of the carrier and the toner, that is, the toner concentration is preferably set at 3 to 15% by weight. The toner concentration of less than 3% by weight hardly provide a desired image density; and the toner concentration exceeding 15% by weight is liable to generate toner scattering and fogging.

A developer obtained by mixing the carrier and the toner produced as described above can be used as a refill developer. In this case, the mixing ratio of the carrier and the toner is 2 to 50 parts by weight of the toner with respect to 1 part by weight of the carrier The electrophotographic developer according to the present invention, prepared as described above, can be used in copying machines, printers, FAXs, printing machines and the like, which use a digital system using a development system in which electrostatic latent images formed on a latent image holder having an organic photoconductive layer are reversely developed with a magnetic brush of a two-component developer having a toner and a carrier while a bias electric field is being impressed. The electrophotographic developer is also applicable to full-color machines and the like using an alternative electric field, in which when a development bias is impressed from a magnetic brush to an electrostatic latent image side, an AC bias is superimposed on a DC bias.

Hereinafter, the present invention will be described specifically by way of Examples and others, but the present invention is not any more limited to these.

Example 1

Raw materials were weighed so that MnO: 39.6 mol %, MgO: 9.6 mol %, $Fe_2O_3$: 50 mol % and SrO: 0.8 mol %, and pulverized for 5 hours by a dry-type media mill (vibration mill, stainless beads of ⅛ inch in diameter), and an obtained pulverized material was pelletized into about 1 mm square by a roller compactor. The MnO raw material used was trimanganese tetraoxide; the MgO raw material, magnesium hydroxide; and the SrO raw material, strontium carbonate. Cl contained in $Fe_2O_3$ as an impurity was 0.11% by weight (1,100 ppm, a value measured by X-ray fluorescence elemental analysis: XRF). In the case of the above-mentioned formulation, since $Fe_2O_3$ was about 71% in weight ratio, Cl originated from $Fe_2O_3$ was estimated to be contained in about 780 ppm in the pellet.

Coarse powder was removed from the pellet by a vibration sieve with apertures of 3 mm, and then, fine powder was removed by a vibration sieve with apertures of 0.5 mm, and thereafter, the pellet was calcined in a continuous electric furnace at 1,200° C. for 3 hours. Then, the calcined pellet was pulverized for 6 hours into an average particle diameter of about 5 μm by using a dry-type media mill (vibration mill, stainless beads of ⅛ inch in diameter); and thereafter, water was added thereto, and the pulverized material was further pulverized for 6 hours by using a wet-type media mill (horizontal bead mill, zirconia beads of 1 mm in diameter). As a result of measurement of the particle diameter (a primary particle diameter after pulverization) of the slurry by a MicroTrac, $D_{50}$ was about 2 μm. A dispersant was added in a suitable amount to the slurry; PVA (10% solution) as a binder was added in 0.4% by weight with respect to the solid content thereof; the slurry was then granulated and dried by a spray drier; an obtained particle (granulated material) was adjusted for the particle size; and thereafter, the granulated material was heated by using a rotary electric furnace in the air atmosphere at 750° C. for 2 hours to remove organic components such as the dispersant and the binder.

Thereafter, the granulated material was held at a sintering temperature of 1,190° C. in an oxygen concentration of 0.7% by volume for 5 hours in a tunnel-type electric furnace. At this time, the temperature-rise rate was set at 150° C./h, and the cooling rate was set at 110° C./h. In order to decrease the Cl concentration contained in the ferrite particle, nitrogen gas was introduced from the outlet port side of the tunnel furnace. At this time, the internal pressure of the tunnel furnace was set at 0 to 10 Pa (positive pressure) so that chlorine generated in sintering was efficiently discharged from the tunnel furnace. Thereafter, the ferrite particle was deagglomerated and further classified to adjust the particle size; and low-magnetic products were segregated by magnetic concentration to obtain a ferrite particle (core material).

Example 2

A ferrite particle (core material) was obtained as in Example 1, except for altering the temperature of the regular sintering to 1,185° C. and the oxygen concentration to 0.5% by volume.

Example 3

A ferrite particle (core material) was obtained as in Example 1, except for altering the temperature of the regular sintering to 1,180° C. and the oxygen concentration to 0.6% by volume.

Example 4

A ferrite particle (core material) was obtained as in Example 1, except for altering the temperature of the regular sintering to 1,175° C. and the oxygen concentration to 0.5% by volume.

Example 5

A ferrite particle (core material) was obtained as in Example 1, except for using $Fe_2O_3$ as an iron oxide as a raw material, in which Cl was 0.25% by weight (2,500 ppm), and altering the temperature of the regular sintering to 1,170° C.

Example 6

A ferrite particle (core material) was obtained as in Example 5, except for altering the calcination temperature to 950° C., carrying out the removal step of organic components such as the dispersant and the binder by using a tunnel-type electric furnace at 650° C., altering the regular sintering temperature to 1,180° C., and altering the oxygen concentration to 0.5% by volume.

Example 7

A ferrite particle (core material) was obtained as in Example 5, except for altering the calcination temperature to 950° C., the temperature of the removal step of organic components such as the dispersant and the binder to 1000° C., the regular sintering temperature to 1,135° C., and the oxygen concentration to 0.7% by volume.

Example 8

A ferrite particle (core material) was obtained as in Example 1, except for altering the regular sintering temperature to 1,175° C., and the oxygen concentration to 0.0% by volume, and thereafter, the obtained carrier core material particle was subjected to a surface oxidation treatment under the conditions of a surface oxidation treatment temperature of 540° C. and the air atmosphere in a rotary electric furnace, to obtain a surface-oxidized carrier core material particle.

Comparative Example 1

As an iron oxide as a raw material, $Fe_2O_3$ containing 0.4% by weight (4,000 ppm) of Cl was used; the calcination temperature was set at 970° C., and the temperature of the removal step of organic components such as the dispersant and the binder was set at 850° C.; and nitrogen gas was introduced in the furnace in the removal step. A ferrite particle (core material) was obtained as in Example 1, except for altering the regular sintering temperature to 1,150° C., and the oxygen concentration to 0.1% by volume.

Comparative Example 2

A ferrite particle (core material) was obtained as in Example 1, except for: using a rotary electric furnace for the calcination and setting the temperature for the calcination at 1,000° C.; using a tunnel electric furnace for the removal step of organic components such as the dispersant and the binder and setting the temperature for the removal step at 650° C.; and altering the regular sintering temperature to 1,190° C., and the oxygen concentration to 0.1% by volume.

Comparative Example 3

A ferrite particle (core material) was obtained as in comparative Example 1, except for altering the calcination temperature to 1,000° C., the regular sintering temperature to 1,190° C. and the oxygen concentration to 0.1% by volume.

Comparative Example 4

A ferrite particle (core material) was obtained as in comparative Example 3, except for introducing nitrogen gas in the calcination, and altering the regular sintering temperature to 1,190° C. and the oxygen concentration to 0.1% by volume.

Properties (the BET surface area, the shape factor SF-1, the volume-average particle diameter, the particle amount of less than 24 μm, the particle density, the apparent density, the saturation magnetization, the Cl/Fe ratio (XRF measurement), and the Cl concentration (elution method)) of the ferrite core materials obtained in Examples 1 to 8 and Comparative Examples 1 to 4 are shown in Table 1. Measurement methods of the other properties were as described above. The measurement results of charge properties, the electric resistance and the XRD measurement of the ferrite core materials are shown in Table 2. The Cl/Fe ratio (XRF measurement) and the charge amount were measured as follows.

[X-Ray Fluorescence Elemental Analysis: XRF Measurement]

As a measuring apparatus, ZSX100s made by Rigaku Corp. was used. About 5 g of a sample was put in a vacuum-use powder sample vessel, which was set on a sample holder; and Cl and Fe were measured by the measuring apparatus described above.

Here, the measurement conditions were: for Cl, using a Cl-Kα line as a measurement line, a tube voltage of 50 kV, a tube current of 50 mA, Ge as a dispersive crystal, and a PC (proportional counter) as a detector; and for Fe, using a Fe-Kα line as a measurement line, a tube voltage of 50 kV, a tube current of 50 mA, LiF as a dispersive crystal, and an SC (scintillation counter) as a detector.

Using respective fluorescent X-ray intensities obtained, Cl/Fe ratios (Cl intensity/Fe intensity) were calculated.

[Charge Amount]

A carrier and a commercially available negatively chargeable toner (cyan toner, for DocuPrintC3530 made by Fuji Xerox Co., Ltd.) used in full-color printers were weighed so that the toner concentration was 6.5% by weight (the toner weight was 3.25 g, and the carrier weight was 46.75 g). The weighed carrier and toner were exposed to respective environments described later for 12 or more hours. Thereafter, the carrier and the toner were put in a 50-cc glass bottle, and stirred at a rotation frequency of 100 rpm for 30 min.

As a charge amount measuring apparatus, a magnet roll in which magnets (magnetic flux density: 0.1 T) of a total of 8 poles of N poles and S poles were alternately arranged on the inner side of an aluminum bare tube (hereinafter, sleeve) of a cylindrical shape of 31 mm in diameter and 76 mm in length, and a cylindrical electrode having a gap of 5.0 mm to the sleeve were arranged in the outer circumference of the sleeve.

0.5 g of a developer was uniformly attached on the sleeve, and thereafter, while the magnet roll, which was on the inner side, was being rotated at 100 rpm with the outer-side aluminum bare tube being fixed, a direct current voltage of 2,000 V was impressed for 60 sec between the outer electrode and the sleeve to transfer the toner to the outer-side electrode. At this time, an electrometer (an insulation-resistance tester, model: 6517A, made by Keithley Instrument Inc.) was connected to the cylindrical electrodes to measure the quantity of charge of the transferred toner.

After the elapse of 60 sec, the impressed voltage was shut off, and after the rotation of the magnet roll was stopped, the outer-side electrode was taken out and the weight of the toner having transferred to the electrode was measured.

The charge amount was calculated from the measured quantity of charge and the weight of the transferred toner.

Here, the environmental conditions were as follows.

The normal temperature and normal humidity (NN environment): a temperature of 20 to 25° C. and a relative humidity of 50 to 60%

The high temperature and high humidity (HH environment): a temperature of 30 to 35° C. and a relative humidity of 80 to 85%

The low temperature and low humidity (LL environment): a temperature of 10 to 15° C. and a relative humidity of 10 to 15%

Judgments were made about absolute values of charge amounts (NN environment) and charge amount ratios (ratios of charge amount values under respective environments). The criterion for judging was four grades of A: excellent, B: good, C: fair, and D: bad. The criterion was specifically as follows.

[Absolute Values of Charge Amounts (NN Environment)]

A: 60 μC/g<the charge amount value

B: 50 μC/g<the charge amount value≦60 μC/g

C: 30 μC/g<the charge amount value≦50 μC/g

D: the charge amount value≦30 μC/g

[Charge Amount Ratios (Ratios of Charge Amount Values under Respective Environments)]

A: the charge amount ratio<1.2

B: 1.2≦the charge amount ratio<1.5

C: 1.5≦the charge amount ratio<2.0

D: 2.0≦the charge amount ratio

TABLE 1

| | Properties of Ferrite Core Materials | | | | | | | | | | | |
|---|---|---|---|---|---|---|---|---|---|---|---|---|
| | Cl/Fe Ratio XRF Measurement | Cl Concentration Elution Method (ppm) | BET Specific Surface Area ($m^2/g$) | Pore Volume (ml/g) | Si Amount (%) | Shape Factor SF-1 | Magnetization 1kOe ($Am^2/kg$) | Magnetization 500Oe ($Am^2/kg$) | Volume-Average Diameter (μm) | Particles of less than 24 μm (vol %) | Particle Density ($g/cm^3$) | Apparent Density ($g/cm^3$) |
| Example 1 | Below detection limit | 6.1 | 0.117 | 0.010 | 0.02 | 113 | 56.7 | 41.7 | 38.2 | 0.6 | 4.86 | 2.16 |
| Example 2 | Below detection limit | 7.8 | 0.129 | 0.012 | 0.03 | 114 | 59.2 | 42.8 | 37.6 | 1.0 | 4.88 | 2.16 |
| Example 3 | Below detection limit | 8.2 | 0.141 | 0.012 | 0.03 | 112 | 56.4 | 42.4 | 37.9 | 0.9 | 4.85 | 2.15 |
| Example 4 | $8.61 \times 10^{-5}$ | 15.3 | 0.164 | 0.017 | 0.02 | 113 | 57.4 | 41.5 | 37.9 | 0.6 | 4.87 | 2.14 |
| Example 5 | $8.56 \times 10^{-5}$ | 20.5 | 0.142 | 0.013 | 0.04 | 112 | 57.3 | 40.3 | 37.6 | 0.8 | 4.85 | 2.17 |
| Example 6 | $1.99 \times 10^{-4}$ | 56.9 | 0.131 | 0.018 | 0.04 | 115 | 57.5 | 40.6 | 37.0 | 0.6 | 4.88 | 2.20 |
| Example 7 | $2.59 \times 10^{-4}$ | 68.6 | 0.137 | 0.018 | 0.05 | 113 | 58.1 | 42.4 | 37.8 | 0.7 | 4.85 | 2.22 |
| Example 8 | Below detection limit | 2.1 | 0.150 | 0.011 | 0.02 | 114 | 58.8 | 40.9 | 37.0 | 0.7 | 4.89 | 2.26 |
| Comparative Example 1 | $2.51 \times 10^{-4}$ | 130.4 | 0.281 | 0.033 | 0.04 | 121 | 56.3 | 41.2 | 37.6 | 0.5 | 4.83 | 2.09 |
| Comparative Example 2 | $2.92 \times 10^{-4}$ | 146.7 | 0.216 | 0.031 | 0.06 | 120 | 59.9 | 41.1 | 36.8 | 3.3 | 4.87 | 2.08 |
| Comparative Example 3 | $3.60 \times 10^{-4}$ | 164.9 | 0.236 | 0.025 | 0.07 | 123 | 59.8 | 40.5 | 39.1 | 2.7 | 4.79 | 2.03 |

TABLE 1-continued

| | Properties of Ferrite Core Materials | | | | | | | | | | | |
|---|---|---|---|---|---|---|---|---|---|---|---|---|
| | Cl/Fe Ratio XRF Measurement | Cl Concentration Elution Method (ppm) | BET Specific Surface Area ($m^2/g$) | Pore Volume (ml/g) | Si Amount (%) | Shape Factor SF-1 | Magnetization 1kOe ($Am^2/kg$) | Magnetization 500Oe ($Am^2/kg$) | Volume-Average Diameter (μm) | Particles of less than 24 μm (vol %) | Particle Density ($g/cm^3$) | Apparent Density ($g/cm^3$) |
| Comparative Example 4 | $5.50 \times 10^{-4}$ | 263.7 | 0.190 | 0.023 | 0.09 | 119 | 60.6 | 40.4 | 37.2 | 1.8 | 4.81 | 2.06 |

TABLE 2

| | Properties of Ferrite Core Materials | | | | | | | |
|---|---|---|---|---|---|---|---|---|
| | Charge Amount (μC/g) | | | Charge Amount Ratio | | | Electric Resistance (Ω) 6.5 mmGap 1000 V | Electric Resistance (Ω) 2.0 mmGap 50 V |
| | HH Environment | NN Environment | LL Environment | LL/NN | LL/HH | NN/HH | HH Environment | NN Environment |
| Example 1 | 66.9 | 67.8 | 68.1 | 1.00 | 1.02 | 1.01 | $1.8 \times 10^8$ | $6.6 \times 10^6$ |
| Example 2 | 65.1 | 64.6 | 65.0 | 1.01 | 1.00 | 0.99 | $2.4 \times 10^7$ | $7.7 \times 10^6$ |
| Example 3 | 63.9 | 65.6 | 67.2 | 1.02 | 1.05 | 1.03 | $7.2 \times 10^7$ | $7.3 \times 10^6$ |
| Example 4 | 59.5 | 64.9 | 66.3 | 1.02 | 1.11 | 1.09 | $3.4 \times 10^7$ | $5.5 \times 10^6$ |
| Example 5 | 48.1 | 57.3 | 60.9 | 1.06 | 1.27 | 1.19 | $1.1 \times 10^8$ | $1.6 \times 10^6$ |
| Example 6 | 27.7 | 39.4 | 39.1 | 0.99 | 1.41 | 1.42 | $1.9 \times 10^7$ | $1.6 \times 10^6$ |
| Example 7 | 26.3 | 35.9 | 38.4 | 1.07 | 1.46 | 1.37 | $2.2 \times 10^8$ | $1.1 \times 10^6$ |
| Example 8 | 68.8 | 71.0 | 70.4 | 0.99 | 1.02 | 1.03 | $5.1 \times 10^8$ | $7.8 \times 10^7$ |
| Comparative Example 1 | 17.8 | 34.1 | 36.9 | 1.08 | 2.07 | 1.92 | $3.7 \times 10^7$ | $5.5 \times 10^6$ |
| Comparative Example 2 | 1.5 | 2.4 | 5.3 | 2.20 | 3.53 | 1.61 | $4.2 \times 10^7$ | $8.2 \times 10^5$ |
| Comparative Example 3 | 1.2 | 2.2 | 6.1 | 2.74 | 5.08 | 1.86 | $4.2 \times 10^7$ | $5.1 \times 10^5$ |
| Comparative Example 4 | 2.2 | 3.7 | 8.3 | 2.24 | 3.77 | 1.68 | $3.8 \times 10^7$ | $6.9 \times 10^5$ |

| | Evaluations | | | | XRD Measurement Results of Core Material Particles obtained | | |
|---|---|---|---|---|---|---|---|
| | Absolute Value of Charge Amount LL | Charge Amount Ratio (Environmental Variation) | | | Sr-Ferrite (wt %) | Sr—Fe Compound (wt %) | Proportion of Sr-Ferrite in Whole Sr—Fe Compound Contained in Particle |
| | Environment | LL/NN | LL/HH | NN/HH | A | B | A (A + B) |
| Example 1 | A | A | A | A | 1.2 | 7.2 | 0.143 |
| Example 2 | A | A | A | A | 2.2 | 6.5 | 0.253 |
| Example 3 | A | A | A | A | 1.8 | 6.9 | 0.207 |
| Example 4 | A | A | A | A | 3.5 | 6.0 | 0.368 |
| Example 5 | B | A | B | A | 4.2 | 5.1 | 0.452 |
| Example 6 | C | A | B | B | 4.9 | 4.7 | 0.510 |
| Example 7 | C | A | B | B | 5.3 | 4.0 | 0.570 |
| Example 8 | A | A | A | A | 0.0 | 7.3 | 0.000 |
| Comparative Example 1 | C | A | D | C | 6.6 | 1.6 | 0.805 |
| Comparative Example 2 | D | D | D | C | 6.5 | 1.6 | 0.802 |
| Comparative Example 3 | D | D | D | C | 7.4 | 1.7 | 0.813 |
| Comparative Example 4 | D | D | D | C | 7.5 | 1.6 | 0.824 |

Example 9

100 parts by weight of the ferrite particle (ferrite core material) obtained in Example 1 and a condensation-crosslinking silicone resin (weight-average molecular weight: about 8,000) having a T unit and a D unit as main components were prepared; an aminosilane coupling agent (3-aminopropyltrimethoxysilane) as an amine compound was added to 5 parts by weight of the silicone resin solution (the resin solution concentration was 20%, so the solid content was 1 part by weight; diluting solvent: toluene) so that the amine compound was 10% by weight with respect to the resin solid content, and the mixture was mixed and stirred by a universal mixing stirrer to coat the surface of the ferrite core material with the resin while toluene was being volatilized.

After it was confirmed that toluene had been volatilized fully, the stirring was continued further for 5 minutes to remove toluene almost completely; thereafter, the treated ferrite particle was taken out from the apparatus, and put in a vessel, which was then placed in a hot-air heating oven to heat the treated ferrite particle at 220° C. for 2 hours.

Thereafter, the ferrite particle was cooled to room temperature, and the ferrite particle whose resin had been cured was taken out; aggregation of the particle was deagglomerated by a vibration sieve of 200M in aperture, and nonmagnetic substances were removed using a magnetic concentrator. Thereafter, coarse particles were removed again by a vibration sieve, thus obtaining a ferrite carrier coated with a resin.

Comparative Example 5

A resin-coated ferrite carrier was obtained as in Example 8, by using the ferrite particle (ferrite core material) obtained in Comparative Example 1.

Charge properties of the resin-coated ferrite carriers obtained in Example 9 and Comparative Example 5 are shown in Table 3. The measurement and the judgment of the charge amount were carried out similarly to the ferrite core materials of Examples 1 to 8 and Comparative Examples 1 to 4 described above.

Cl concentrations, the charge amounts were low, and the environmental variations in charge amounts were large.

As is clear from the results shown in Table 3, since the resin-coated carrier shown in Example 9 used a ferrite core material having a suitable Cl concentration, the resin-coated carrier was revealed to have good charge properties similarly to the ferrite core material. By contrast, since the resin-coated carrier shown in Comparative Example 5 used a ferrite core material containing a high Cl concentration, the charge amount was low even if the carrier was coated with a resin, and the environmental stability of the charge amount also was remarkably bad.

Therefore, when the resin-coated ferrite carrier represented by Example 9 using the ferrite core material described in Example 1 is used actually as a developer, since the deterioration of the carrier performance during usage is little, and the charge properties are stable even if the environment varied, good image quality having no image faults such as toner scattering and fogging is easily conceivably provided. Further, the resin-coated ferrite carrier can supposedly be used suitably as a refill developer.

By contrast, when the resin-coated ferrite carrier represented by Comparative Example 5 using the ferrite core material described in comparative Example 1 is used actually as a developer, since the charge amount is low, and the charge amount greatly varies by the environmental variation, image faults such as toner scattering and fogging are easily conceivably caused.

Since the ferrite core material for an electrophotographic developer according to the present invention has a desired high chargeability, and exhibits a small environmental variation in the charge amount, a ferrite carrier for an electrophotographic developer using the ferrite core material also has excellent charge properties. Therefore, the ferrite core material for an electrophotographic developer and the carrier using the ferrite core material according to the present invention can be used broadly in the fields of full-color machines requiring high image quality and high-speed machines requiring reliability and durability of image maintenance.

TABLE 3

| | | Properties of Resin-Coated Ferrite Carriers | | | | | | Evaluations | | | |
|---|---|---|---|---|---|---|---|---|---|---|---|
| | | Charge Amount (μC/g) | | | | | | Absolute Value of Charge Amount | Charge Amount Ratio (Environmental Variation) | | |
| | Core | H/H | N/N | L/L | Charge Amount Ratio | | | N/N | | | |
| | Material | Environment | Environment | Environment | LL/NN | LL/HH | NN/HH | Environment | LL/NN | LL/HH | NN/HH |
| Example 9 | Example 1 | 60.8 | 61.2 | 63.9 | 1.04 | 1.05 | 1.01 | A | A | A | A |
| Comparative Example 5 | Comparative Example 1 | 12.6 | 29.5 | 32.3 | 1.09 | 2.56 | 2.34 | D | A | D | D |

(Evaluations)

As is clear from the results shown in Table 1 and Table 2, since the ferrite core materials described in Examples 1 to 8 had suitable Cl concentrations, the ferrite core materials gave high charge amounts of 30 μC/g or higher. The ferrite core materials also exhibited no large variations in the charge amounts measured under respective environments, and stable charge properties. By contrast, since the ferrite core materials described in Comparative Examples 1 to 4 contained too high

What is claimed is:

1. A ferrite core material for an electrophotographic developer, the ferrite core material having a ferrite particle composition represented by the formula (1) shown below, containing SrO replacing a part of (MnO) and/or (MgO) in the formula (1) shown below, having a Cl concentration of 0.1 to 100 ppm, as measured by an elution method of the ferrite core material, and having strontium ferrite and Sr—Fe compounds, wherein the proportion of the strontium ferrite in the whole of Sr—Fe compounds contained in the ferrite particle is in the range shown in the formula 2 below:

$$(MnO)x(MgO)y(Fe_2O_3)z \quad (1)$$

wherein x=35 to 45 mol %, y=5 to 15 mol %, z=40 to 60 mol %, and x+y+z=100 mol %;

$$0 \leqq A/(A+B) \leqq 0.8 \quad (2)$$

wherein A is the content (% by weight) of the strontium ferrite and B is the content (% by weight) of the Sr—Fe compounds.

2. The ferrite core material for an electrophotographic developer according to claim 1, wherein a replacement amount of SrO is 0.1 to 2.5 mol %.

3. The ferrite core material for an electrophotographic developer according to claim 1, wherein the ferrite particle has a BET specific surface area of 0.1 to 0.185 $m^2/g$.

4. The ferrite core material for an electrophotographic developer according to claim 1, wherein the ferrite particle has a shape factor SF-1 of 100 to 120.

5. The ferrite core material for an electrophotographic developer according to claim 1, wherein the ferrite particle has an electric resistance of $1\times10^6$ to $1\times10^9\Omega$ as measured at normal temperature and normal humidity.

6. The ferrite core material for an electrophotographic developer according to claim 1, wherein the ferrite core material has a volume-average particle diameter of 20 to 50 μm, a magnetization at application of 1 kOe of 50 to 70 $Am^2/kg$, a particle density of 4.0 to 5.5 $g/cm^3$ and an apparent density of 1.5 to 2.5 $g/cm^3$, and contains 5% by volume or less of particles of less than 24 μm.

7. The ferrite core material for an electrophotographic developer according to claim 1, wherein the ferrite core material has a magnetization at application of 500 Oe of 30 to 50 $Am^2/kg$.

8. A ferrite carrier for an electrophotographic developer, the ferrite carrier being prepared by coating a surface of a ferrite core material according to claim 1 with a resin.

9. An electrophotographic developer, comprising a ferrite carrier according to claim 8 and a toner.

10. The electrophotographic developer according to claim 9, wherein the electrophotographic developer is used as a refill developer.

* * * * *